United States Patent [19]

Schweitzer et al.

[11] 4,084,510

[45] Apr. 18, 1978

[54] INK FOUNTAIN

[75] Inventors: Roy C. Schweitzer, Hoffman Estates; Lee B. Fiori, Leyden Township, Cook County, both of Ill.

[73] Assignee: Addressograph-Multigraph Corporation, Cleveland, Ohio

[21] Appl. No.: 800,814

[22] Filed: May 26, 1977

Related U.S. Application Data

[63] Continuation of Ser. No. 607,238, Aug. 25, 1975, abandoned.

[51] Int. Cl.[2] ..... B41F 31/04

[52] U.S. Cl. ..... 101/365; 101/350

[58] Field of Search ..... 101/365, 350, 351, 363, 101/364; 118/261

[56] References Cited

U.S. PATENT DOCUMENTS

| | | | |
|---|---|---|---|
| 1,130,744 | 3/1915 | Cabombarde | 118/261 X |
| 2,568,761 | 9/1951 | Peyrebrune | 101/218 |
| 2,827,011 | 3/1958 | Schaefer | 118/261 X |
| 3,855,927 | 12/1974 | Simeth | 101/365 X |
| 3,895,575 | 7/1975 | Cappel | 101/365 X |
| 3,913,479 | 10/1975 | Cappel | 101/365 |

FOREIGN PATENT DOCUMENTS

| | | | |
|---|---|---|---|
| 2,230,126 | 1/1974 | Germany | 101/365 |

*Primary Examiner*—J. Reed Fisher
*Attorney, Agent, or Firm*—Russell L. Root

[57] ABSTRACT

A novel ink fountain comprises a fountain roller radially approached by an ink supporting doctor blade. In order to retain low viscosity inks in the fountain, the blade must approach very closely to the fountain roller surface without touching it. To accommodate the potentially irregular surface of fountain rollers, the blade is rendered transversely deflectable in segments by means of cut-outs, and vernier adjustment means acting on the segments may be used to conform the blade closely to the roller surface condition.

3 Claims, 4 Drawing Figures

INK FOUNTAIN

This is a continuation of application Ser. No. 607,238 filed Aug. 25, 1975 now abandoned.

BACKGROUND OF THE INVENTION

It has been found desirable to provide certain automated lithographic duplicators with ink of low viscosity and also to do this in such manner that the temperature rise of the ink in the fountain due to working of the ink is minimized. This is accomplished by a radially presented blade which acts to doctor a thick film of ink onto the surface of the fountain roller and at the same time to support the body of ink in the fountain. The gap between the blade and the fountain roller must be accurately adjusted to close tolerances to give a very small gap in order to prevent leakage of the low viscosity ink when the machine is not running.

SUMMARY OF THE INVENTION

The problems in achieving close and fairly uniform spacing between the blade and the surface of the fountain roll arise by reason of the fact that fountain rollers are not always precisely uniform to the degree necessary to achieve the spacing required. They may suffer from taper, crown anti-crown, and eccentricity, and it is necessary to provide a blade which is sufficiently adjustable to take care of the first three of these slight vagaries of roller configuration, and to some extent the last.

In accordance with the present invention the flat blade has been provided with transverse flexibility by cutting out or notching it deeply at at least two points to provide a thin section with higher flexibility. The blade is supported on adjustment devices which will permit setting its several sections each in close proximity to the portion of the fountain roller which it opposes.

DETAILED DESCRIPTION OF THE PREFERRED EMBODIMENT

Figure 1:
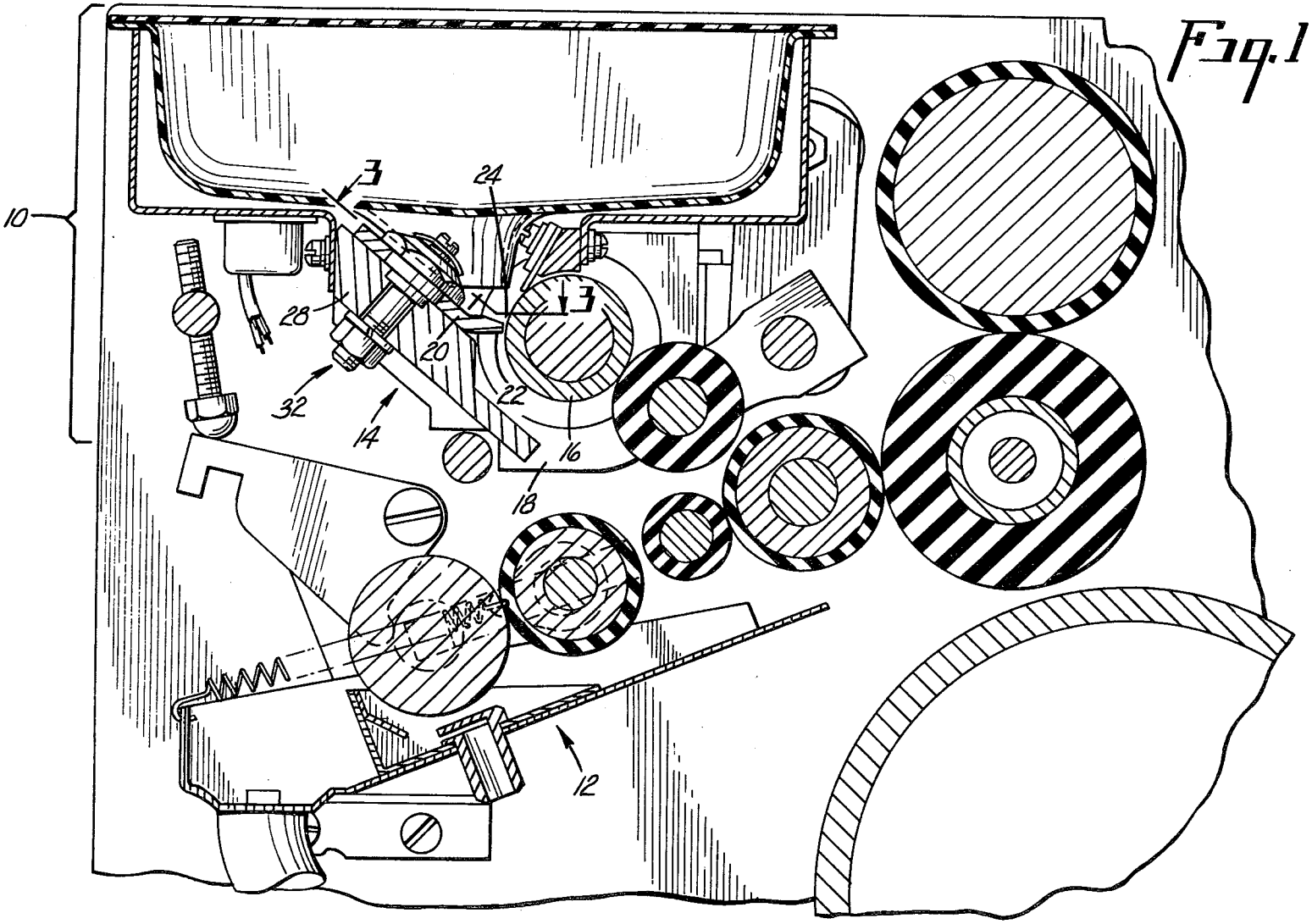
FIG. 1 is a vertical section of the ink and moisture systems of a lithographic duplicator showing an ink fountain in accordance with the present invention.

With reference to the drawing, there is shown in FIG. 1 an ink train 10 and a moisture system 12 of a lithographic duplicator.

The ink system 10 includes an ink fountain 14 embodying the usual fountain roller 16. To confine and support the bead of ink which feeds the fountain roller there are end plates, one of which is shown at 18, and an ink blade 20 extending therebetween.

In this particular fountain the ink blade 20, instead of being tangent with the fountain roller, has an edge 22 which approaches the latter in a radial direction. The clearance between the edge 22 and the surface of roller 16, indicated by reference character 24, is very small, on the order of 0.003 inches or less, for example, in order to hold a lithographic ink of low viscosity within the fountain without leakage during standing.

The present invention deals with the manner of accurately setting and holding this small clearance without creating contact with the fountain roller at any point which contact would severely damage the fountain roller.

Figure 2:
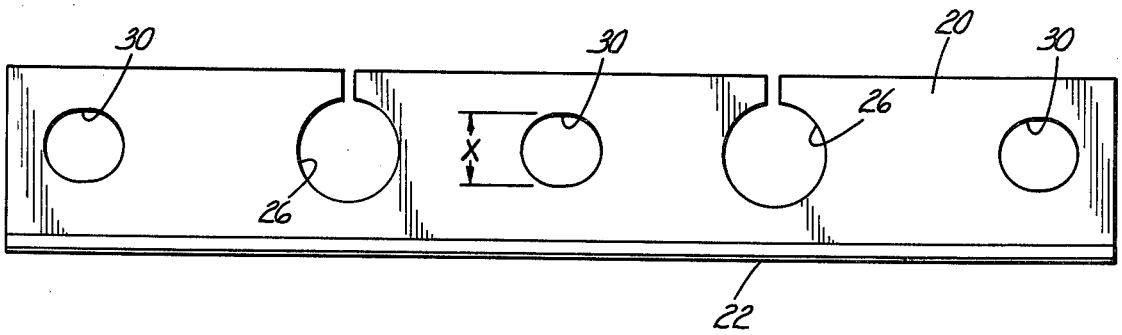
FIG. 2 is a top face view, to a slightly smaller scale, of the fountain blade shown in FIG. 1.

The blade 20, in order to be able to undergo adjustment somewhat independently in various segments must be longitudinally flexible in a widthwise direction. As seen best in FIG. 2 this type of flexibility is brought about by providing blade 20 with a number of deep cutouts or notches 26, in this case two. These provide a certain amount of lateral flexibility to the blade 20 in its own plane so that the edge 22, normally straight, can be forced into a configuration conforming approximately to the surface of the fountain roller 16.

The blade 20 is mounted on an anvil 28 (FIG. 1), positioned adjacent the fountain roller 16, and for this purpose is provided with three openings 30 which receive three mounting and adjustment devices associated with the anvil 28. One of these mounting devices is indicated generally at 32 in FIG. 1, and is shown in detail in FIGS. 3 and 4.

The mounting device includes a threaded shaft member or screw 34 which has a kerf 36 at its head end and a stepped enlargement midway of its length. The latter includes cylindrical peripheries of two diameters, the first, designated 38, is concentric and rotatably fits a recess 40 in the upper surface of the anvil 28. The second cylinder 42 is above the cylinder 38 and is eccentric with respect to the axis of the screw 34 and cylinder 38. Surrounding the cylinder 42 is a ring 44 forming part of and porjecting downwardly from a hexagonal adjusting head 46 which is retained on the screw for rotation relative thereto by any suitable retaining means, for example, a spring snap washer 48 which also serves to retain the adjusting head 46 in desired set position.

Figure 3:
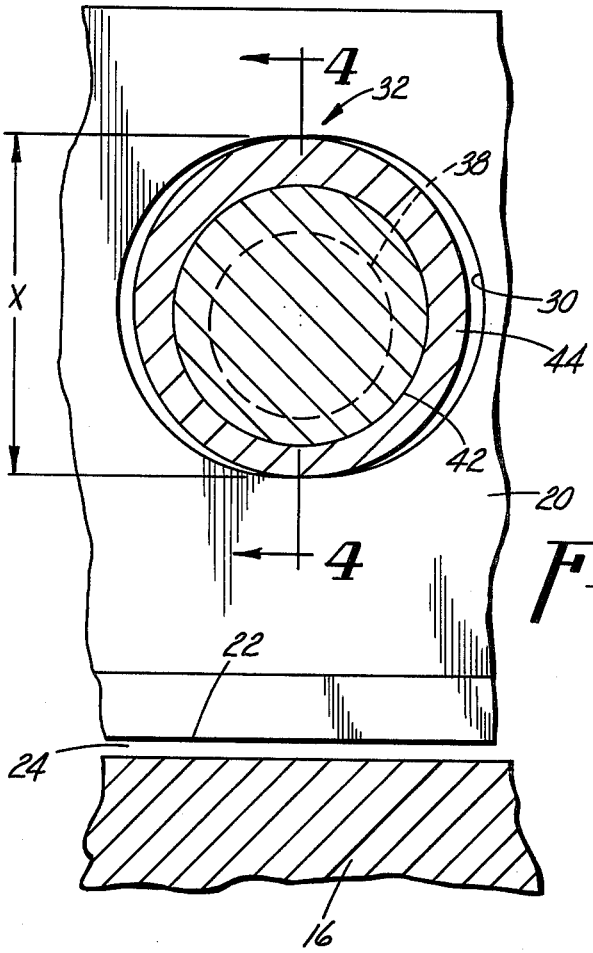
FIG. 3 is a detail section to a larger scale taken on line 3—3 of FIG. 1, showing one of the adjustment mountings for the blade.
Figure 4:
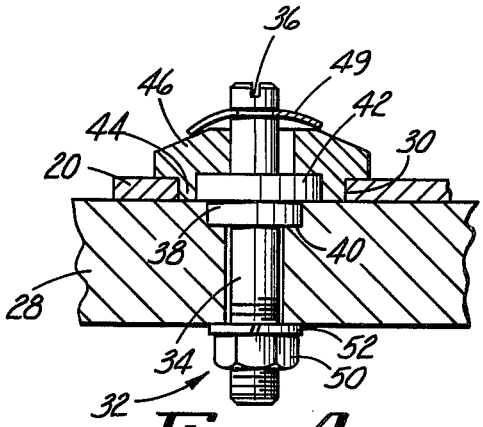
FIG. 4 is a detail section to a slightly smaller scale than FIG. 3, taken substantially on line 4—4 of FIG. 3.

As can be seen in FIGS. 3 and 4, the inner cylindrical periphery of the ring 44 rotates freely on the cylindrical surface 42, and the outer cylindrical periphery which is slightly eccentric to the inner periphery is received in an opening 30 of the blade 20. The openings 30 are slightly oval, the shorter or X dimension running transversely of the blade and the longer dimensions being parallel to the blade edge to allow for independent throw of the several eccentrics. The dimension X of the blade opening fits the exterior of the ring 44 and the inner surfaces of the blade openings at opposite ends of this X dimension serve as the follower surfaces for coaction with the outer periphery of the cam ring 44.

In order to simplify adjustment, the upper end of the screw 34 and the upper face of adjusting head 46 are each suitably marked to show the direction of the high point on the corresponding eccentric.

In order to clamp the screw 34 in place in the anvil 28, its lower end carries a clamp nut 50 and lock washer 52.

STATEMENT OF OPERATION

In the specific construction described and illustrated, and with one particular type of ink, it is desired to establish and preserve a fairly uniform clearance 24 between the blade 20 and the roller 16 of about 0.0027 inches (+0.003 inches and −0.002 inches). Because of the irregularity and eccentricity of rollers normally commercially available this is not usually possible, but in any case a minimum gap of 0.0015 at any place along the roller is sought to be established.

This is accomplished by first setting all of the screws 34, using kerfs 36, at a home position; i.e., at a point where the high points are turned away from the blade edge. Similarly the adjusting heads 46 are also turned to a home position such that the high points of their rings 44 are also turned away from the blade edge. The throw of the eccentric cam 42 is substantially larger than that of the eccentric cam 44, and gives a gross setting while the latter gives a fine setting.

The screws 34 and their eccentric cams 42 are then rotated (with the adjustment heads simultaneously being maintained in home position) until a feeler gauge shows a gap at 24 of roughly 0.004 to 0.005 inches opposite each of the adjustment sites. The screws 36 are then clamped in this adjusted position using nuts 50. This adjustment is made with the roller set in the rotary position where the gap is widest, and thereafter the setting is checked to be sure that the initial rough tolerances are maintained in all rotary positions of the roller. If the equipment cannot be adjusted to this condition, then the roller is excessively eccentric and must be reworked or replaced.

At this stage the fine setting is made by means of adjusting heads 46 which are rotated until the desired setting between 0.0025 inches and 0.0030 inches is obtained. This setting is preferably made in steps so that all three eccentrics 44 advance substantially together.

Finally, the clearance 24 is gauged all the way around the roller circumference to be sure that no locations provide a spacing below the 0.0015 inch limit.

It is also possible to make tailored adjustments in case any portion of the printed product seems to indicate a suggestion of ink starvation relative to other portions, a very slight adjustment of the corresponding adjusting head 46 may be used to correct the condition.

The arrangement disclosed which provides both a coarse and fine setting not only makes the adjustment less difficult to perform, but provides a construction much less subject to wear and hence far more durable than a single adjustment arrangement.

It is noted that the settings do not move the portions of the blade in a directly radial fashion because of the slope of the anvil 28. The movement, however, is so slight that the approach of the blade edge 22 to the fountain roller 16 remains substantially radial. Moreover the sloped arrangement of the blade further simplifies setting of the gap since the gap change is substantially less than the actual blade edge movement due to the angular relation of the plane of adjustment to the plane of the gap.

What is claimed is:

1. An ink fountain for a lithographic duplicator comprising:

a fountain roller;

a blade support anvil adjacent the fountain roller and having a flat blade support and guiding surface;

an ink supporting and doctor blade with its long axis parallel to said roller and provided with an edge portion out of contact with, but in close proximity to, the surface of said roller defining therewith a minute ink metering gap, said blade having a flat body portion lying in contact with the blade support surface of said anvil and being longitudinally flexible in a widthwise direction to a degree such that segments of its length are somewhat independently movable so as to allow adjustment in conformity with roller surface variations to achieve a gap of the required degree of minuteness and uniformity, said blade including a plurality of follower openings spaced along its length; and independently acting adjusting devices mounted on said anvil, each positioned to enter one of said follower openings and coact with the edges thereof, said adjusting devices each comprising:

a post rotatable on the anvil passing through the corresponding blade opening and carrying a first eccentric cam for coarse adjustment;

means for clamping the first eccentric cam in desired rotary position;

a second eccentric cam embracing the first eccentric cam and rotatable thereon, said second eccentric cam including a cam profile for fine adjustment engaging the edges of its corresponding follower opening; and drive means for setting the second eccentric cam in desired rotary position.

2. An ink fountain for a lithographic duplicator comprising:

a fountain roller;

a blade support anvil adjacent the fountain roller and having a plane blade support and guiding surface parallel to the axis of the fountain roller and so disposed that the roller axis lies significantly outside of its plane extension;

an ink supporting and doctor blade with its long axis parallel to said roller and provided with a marginal strip portion out of contact with, but in close proximity to, the surface of said roller defining therewith a minute ink metering gap, and a wider body portion resting upon and guided by the support surface of the anvil, said blade being longitudinally flexible in a widthwise direction to a degree such that segments of its length are somewhat independently movable so as to allow adjustment in conformity with roller surface variations to achieve a gap of the required marginal of minuteness and uniformity, said margina;l strip portion being bent out of the plane of said body portion at a substantial angle significantly less than ninety degrees, said blade being so disposed upon said anvil that the marginal strip portion extends substantially radially of said fountain roller; and adjusting means for said blade including plural adjusting devices each acting on a section of the body portion of the flexible blade to effect adjustment of that portion of the blade in a direction parallel to the support plane of the anvil.

3. An ink fountain as set forth in claim 2 in which the wider body portion of the blade is provided with a plurality of follower openings, and in which the adjusting devices each comprise:

a post rotatable on the anvil passing through the corresponding blade opening and carrying a first eccentric cam for coarse adjustment;

means for clamping the first eccentric cam in desired rotary position;

a second eccentric cam embracing the first eccentric cam and rotatable thereon, said second eccentric cam including a cam profile for fine adjustment engaging the edges of its corresponding follower opening; and drive means for setting the second eccentric cam in desired rotary position.

* * * * *